United States Patent [19]

Markle

[11] Patent Number: 4,807,511

[45] Date of Patent: Feb. 28, 1989

[54] CARTRIDGE SHELL FLASH HOLE UNIFORMER

[76] Inventor: Kenneth E. Markle, 2525 Primrose La., York, Pa. 17404

[21] Appl. No.: 163,747

[22] Filed: Mar. 3, 1988

[51] Int. Cl.[4] ..... F42B 33/00; F42B 35/02; F42B 33/10

[52] U.S. Cl. ..... 86/24; 29/1.3; 86/23; 86/36; 86/37

[58] Field of Search ..... 86/36, 23, 37, 38, 32, 86/24; 29/1.3, 1.31, 1.32; 102/204, 470, 468; 81/3.49

[56] References Cited

U.S. PATENT DOCUMENTS

| | | | |
|---|---|---|---|
| 1,269,249 | 6/1918 | Barnes | 86/36 |
| 3,049,044 | 8/1962 | English | 86/24 |
| 3,134,293 | 5/1964 | Lee | 86/24 |
| 3,283,643 | 11/1966 | Mittelsteadt | 86/36 |
| 3,313,201 | 4/1967 | Lawrence | 86/32 |
| 4,163,410 | 8/1979 | Dillon | 86/23 |
| 4,189,980 | 2/1980 | Schaenzer | 86/24 |
| 4,383,469 | 5/1983 | MacMillan | 86/10 |
| 4,385,545 | 5/1983 | Duer | 86/28 |
| 4,385,546 | 5/1983 | Lee | 86/36 |
| 4,637,291 | 1/1987 | Alexander | 86/23 |
| 4,732,073 | 3/1988 | Semon | 86/1.1 |

*Primary Examiner*—Howard J. Locker
*Attorney, Agent, or Firm*—Daniel J. O'Connor

[57] ABSTRACT

A handloader tool for use in the fabrication of cartridge shells. The tool accomplishes uniform flash hole sizing. The tool includes a depth gage section which results in a cutting tool being inserted to a constant uniform depth into the cartridge flash hole. The cutting tool has an angled upper portion to provide a uniform chamfer of, for example, 60 degrees at the flash hole exit area.

The overall tool assembly further includes a slidable centering cone to provide means wherein the cutting tool is always inserted at a desired straight angle into the flash hole area.

The invention further includes a method of flash hole uniforming using the described handloader tool.

1 Claim, 3 Drawing Sheets

CARTRIDGE SHELL FLASH HOLE UNIFORMER

BACKGROUND AND OBJECTS OF THE INVENTION

This invention relates generally to the hand-loading of cartridge shells and, in particular, to work performed on the shell as part of the hand-loading process.

As shown in FIG. 1, a cartridge shell 10 includes a cylindrical wall 11, a base 12 and a shell upper rim 14. A primer chamber 15 is formed in the shell base 12 as shown.

During the manufacture of handloader shells 10, a flash hole 16 is also formed, typically in a punch press operation into the brass shell. While the punch formation of the flash hole 16 is economical, it typically leaves irregular breakouts and burrs at the inner portion of the flash hole as indicated at numerals 18 and 19.

Since the aforementioned breakouts and burrs are not uniform from shell to shell, the flash hole exit orifice varies significantly. Such results in variations in the primer flame front from shot to shot causing inconsistent velocity pressure and consequent loss of accuracy.

It has been recognized by those of skill in the art that shell to shell uniformity of the flash hole is of critical importance in achieving the close shot groupings desired in handloader gun competitions. Accordingly, the uniforming of flash holes has been practiced for nearly twenty years.

In a typical handloader flash hole uniforming process, a hand-held cutter is inserted into the flash hole 16 and used to ream and deburr the flash hole. It is also known that it is desirable to chamfer the flash hole exit orifice to provide even pressures and velocities within the shell.

With such manual uniformer operations, however, variations in the flash hole size and shape from shell to shell inevitably occur since the handloader cannot be sure of the depth of insertion of the cutting tool.

While flash hole uniformer tools have been known in the art, they are typically useable only for a shell of a given height and a single tool cannot be used for the wide range of shell heights encountered.

Accordingly, it is an object of the present invention to provide a flash hole uniformer tool which has a depth gage formed around the cutting tool in such manner that a uniform cutter depth is always achieved.

It is a further object of the invention to provide a flash hole uniformer which includes a slidable centering cone formed thereon such that the cutting tool always enters and does work on the flash hole at the desired straight angle.

It is also an object of the invention to provide a flash hole uniformer tool in which a single tool may be utilized for all standard rifle and pistol shells.

It is still a further object of the invention to demonstrate a flash hole uniformer tool which may be economically manufactured and sold to those of skill in the handloader arts.

These and other objects and advantages of the invention will be appreciated by those of skill in the art in the specification which follows.

PRIOR ART PATENTS

The most closely known prior art patents are listed as follows: U.S. Pat. No. 3,134,293 issued to Lee on May 26, 1964; U.S. Pat. No. 3,049,044 issued to English on Aug. 14, 1962; U.S. Pat. No. 4,189,980 issued to Schaenzer on Feb. 26, 1980; and U.S. Pat. No. 4,383,469 issued to MacMillan on May 17, 1983.

The patents of Lee, English and Schaenzer illustrate generally tools which extend through a cartridge shell and also through the flash hole to perform a function of use to those in the handloader arts. Typically, they are used to remove the spent primer cap.

However, the patents of Lee, English and Schaenzer are not equipped to perform the flash hole deburring and chamfering functions which will be further described with regard to the present invention.

The patent issued to MacMillan (U.S. Pat. No. 4,383,469) illusrates a cutting tool which is utilized in the munition arts. However, the cutting tool of MacMillan is used to size a paper covering for flash holes rather than the flash hole itself. Thus, the piercing tool of MacMillan is shaped differently from the cutting zone of the present invention. MacMillan further does not include the depth gage control or centering cone structures of the present invention.

BRIEF DESCRIPTION OF THE DRAWING FIGURES

FULL DESCRIPTION OF THE PREFERRED EMBODIMENT

Figure 1:
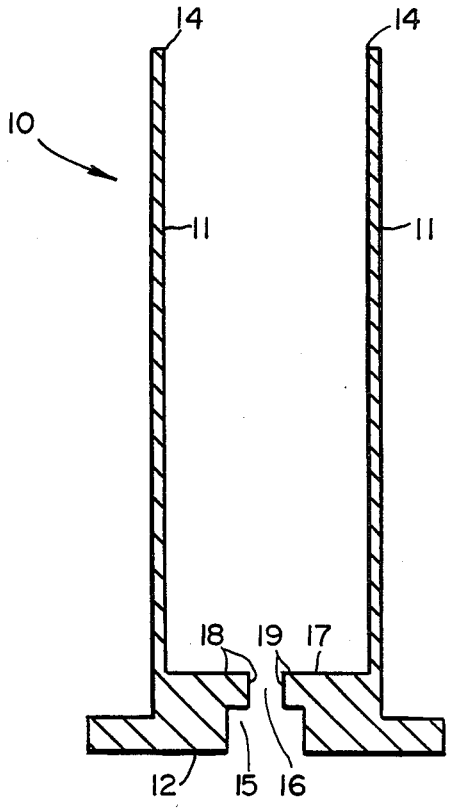
FIG. 1 shows a side sectional view of a shell before the uniforming process has occurred.

As shown in FIG. 1, shell 10 has a cylindrical wall 11 and an upper rim 14 formed as a part thereof. The shell 10 further includes a unitary shell base 12.

A primer chamber 15 is formed as a part of the shell base 12. Flash hole 16 is typically press punched into the shell as previously described. Such manufactured press punching typically results in uneven breakouts and burrs, shown at 18 and 19, in the flash hole 16 and at the exit orifice of the flash hole.

The shell structure of FIG. 1 also shows an inside bottom wall 17.

Figure 2:
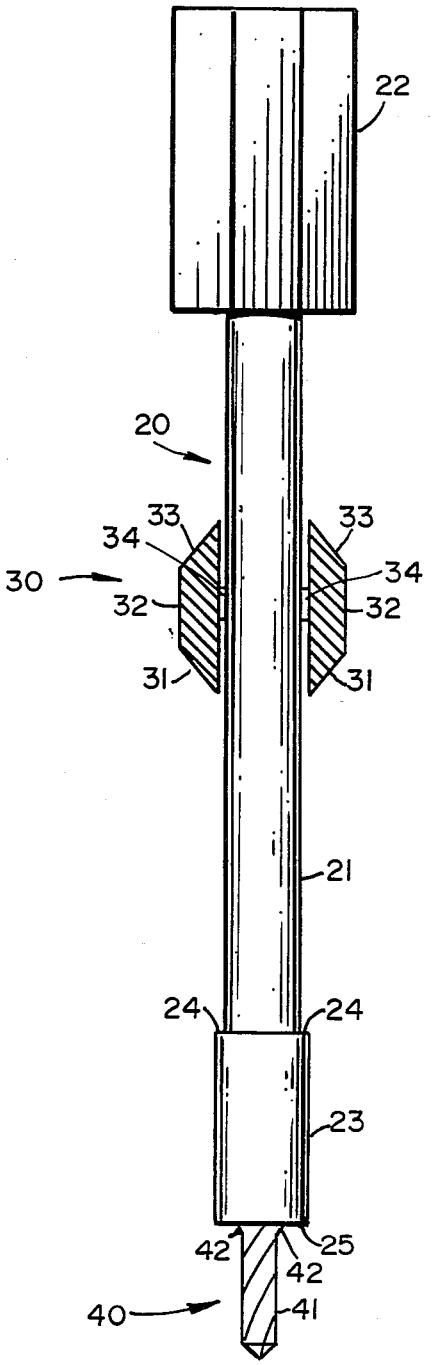
FIG. 2 shows a side view of the flash hole uniformer tool of the present invention.

In order to simultaneously ream, deburr and chamfer the flash hole 16, the flash hole uniformer tool of FIG. 2 is utilized.

As shown in FIG. 2, the tool has a solid cylindrical centerpiece 21 with upper and lower ends.

A tool handle 22 is fixedly attached to the upper end of centerpiece 21. Handle 22 has multiple flat sides formed thereon so that the tool will not easily roll from a workbench surface.

A cylindrical depth gage 23 is threadedly attached to the lower end of tool centerpiece 21. It is noted that the depth gage 23 has a slightly larger outer diameter than the centerpiece 21 for reasons to be further explained below.

The cutter 40 is positioned such that its upper end is fixedly secured within depth gage 23. The lower end of cutter 40 protrudes from the depth gage 23.

The protruding portion of cutter 40 consists of a straight section or zone 41 for reaming the flash hole if required. The protruding portion of cutter 40 also includes an angled section or zone 42 which serves to debur and chamfer the regions 18 and 19 of shell 10.

It will thus be appreciated by those of skill in the art that when the uniformer tool 20 is inserted into shell 10, the tool is manually turned until the lower stop edge 25 of depth gage 23 contacts the inside bottom surface 17 of the shell 10.

Figure 3:
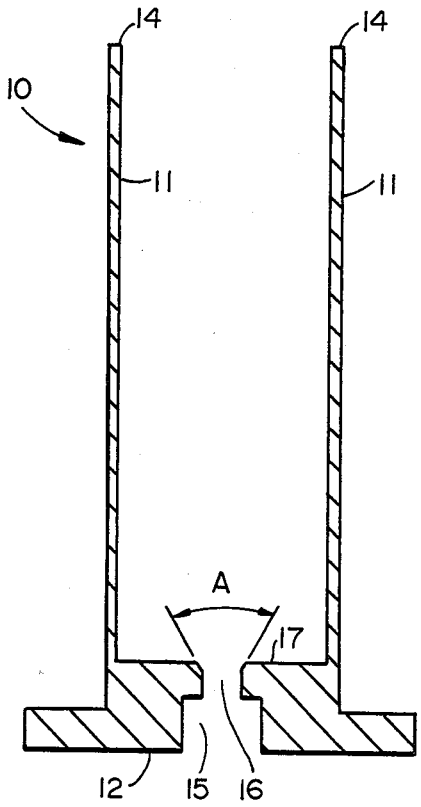
FIG. 3 shows a side sectional view of a shell after being treated by the uniformer tool of the present invention.

During such manual turning, the reaming, deburring and chamfering processes take place simultaneously with the result that the flash hole is shaped as shown in FIG. 3 with the 60 degree chamfer angle A at the flash hole exit orifice and with the breakouts and burrs (illustrated at 18 and 19 of FIG. 1) having been removed.

A further advantageous aspect of the invention lies in the use of an annular sliding centering cone 30.

The centering cone 30 slides up and down along centerpiece 21 via the internal annular rim 34. The centering cone 30 is retained on the centerpiece 21 (at its lower end) by way of contact between the ledge 24 and the internal annular rim 34. Thus, the larger outer diameter of depth gage 23 serves to retain the centering cone 30 from slipping off of centerpiece 21.

The centering cone 30 has a lower conical surface or zone 31, a plurality of flat side surfaces or zones 32, and an upper conical surface or zone 33.

It will thus be appreciated that, when the tool 20 is inserted into shell 10, the centering cone 30 is slid downwardly until conical surface 31 contacts the inner portions of upper shell rim 14. The centering cone 30 is then manually held in position against the shell upper rim 14.

Such action has the effect of centering the tool and the cutter 40 relative to the flash hole. Thus, the cutter 40 will always and uniformly enter the flash hole at the desired straight angle.

Such feature adds another degree of uniformity which has not heretofore been achieved in the art.

It will thus be realized by those of skill in the art that the combination of depth control and centering control results in a highly superior uniformer tool.

Another significant advantage of the invention structure is that tool described may be utilized with any standard caliber rifle and pistol shell. That is, since the depth gage 23 is adjacent the cutter 40 and fits inside the shell 10, and since the centering cone 30 is slidable, the tool can be used with a shell of any standard height.

Thus, a single tool may be utilized in place of the multiple tools currently required in the art. Further, the cutting of shell casings to a single height for handloading is not required by use of the tool of the present invention.

While there has been illustrated and described what is at present considered to be a preferred embodiment of the present invention, it will be appreciated that numerous changes and modifications are likely to occur to those skilled in the art, and it is intended herein to cover all those changes and modifications which fall within the true spirit and scope of the present invention.

I claim:

1. In combination with a cartridge shell (10) having a cylindrical wall (11), a base (12), a shell upper rim (14) and a primer chamber (15) formed in the shell base (12).

wherein said cartridge shell has a flash hole (16) which extends between the primer chamber (15) and an interior portion of the cartridge shell, wherein said flash hole (16) has an exit orifice which is adjacent to an inside bottom wall (17) of the cartridge shell, a flash hole uniformer tool (20) having an elongated cylindrical centerpiece (21) with a first lower end and a second upper end, wherein said first lower end of said centerpiece (21) has a depth gage (23) attached thereto, wherein said depth gage (23) has an upper end (24) and a lower end (25)

wherein a cutter (40) is attached to and protrudes from said depth gage lower end (25), means whereby, upon insertion of the cutter (40) into the flash hole (16) to a desired depth, the lower end (25) of said depth gage contacts said inside bottom wall 917) of the cartridge shell to provide uniform insertion of the cutter (40) into the flash hole (16) (.), wherein said flash hole uniformer tool (20) includes a centering cone (30) having an internal annular rim (34) formed therein to provide means whereby said centering cone is slidable along said tool centerpiece (21), wherein said centering cone (30) has a lower conical zone (31) formed thereon to provide means wherein said conical zone (31) contacts the inner portions of the upper shell rim (14) upon use of the tool, wherein said depth gage (23) is of slightly larger diameter than said tool centerpiece (21) to provide means wherein said centering cone (30) is retained on the lower end of said tool centerpiece (21), wherein said cutter (40) includes a straight zone (41) for reaming the flash hole (16) if required and an angled zone (42) for deburring and chamfering the exit orifice of flash hole (16).

wherein said cutter angled zone (42) lies in the region of the lower end (25) of said depth gage (23).

* * * * *